US006554690B1

(12) United States Patent
Jutz

(10) Patent No.: US 6,554,690 B1
(45) Date of Patent: Apr. 29, 2003

(54) DRIVE DEVICE FOR A GRINDING, LAPPING OR BUFFING-TOOL BODY

(75) Inventor: Stefan Jutz, Vienna (AT)

(73) Assignee: Modto Corp., Lewes, DE (US)

( * ) Notice: Subject to any disclaimer, the term of this patent is extended or adjusted under 35 U.S.C. 154(b) by 0 days.

(21) Appl. No.: 10/070,964

(22) PCT Filed: Sep. 7, 2000

(86) PCT No.: PCT/AT00/00242

§ 371 (c)(1),
(2), (4) Date: Mar. 13, 2002

(87) PCT Pub. No.: WO01/19568

PCT Pub. Date: Mar. 22, 2001

(30) Foreign Application Priority Data

Sep. 15, 1999 (AT) ..... 1583/99

(51) Int. Cl.[7] ..... B23F 21/03

(52) U.S. Cl. ..... 451/552; 451/557

(58) Field of Search ..... 451/552, 557, 451/555, 558, 312, 319

(56) References Cited

U.S. PATENT DOCUMENTS 4,825,597 A * 5/1989 Matechuk ..... 451/557

* cited by examiner

*Primary Examiner*—Eileen P. Morgan
(74) *Attorney, Agent, or Firm*—Collard & Roe, P.C.

(57) ABSTRACT

A drive arrangement for a grinding, lapping or polishing tool body (1, 2) comprising a drive rod (3) for the tool body (1, 2) wherein a substantially cylindrical groove (6, 10) is provided in the tool body (1, 2) for a substantially positive-fit, articulated connection between the tool body (1, 2) and the drive rod (3), the drive rod (3) engaging in this groove with a rounded, flattened end (4) thereof.

19 Claims, 2 Drawing Sheets

DRIVE DEVICE FOR A GRINDING, LAPPING OR BUFFING-TOOL BODY

CROSS REFERENCE TO RELATED APPLICATIONS

Applicant claims priority under 35 U.S.C. §119 of Austrian Application No. A 1583/1999, filed Sep. 15, 1999. Applicant also claims priority under 35 U.S.C. §120 of PCT/AT00/00242, filed Sep. 7, 2000. The international application under PCT article 21(2) was not published in English.

BACKGROUND

The invention relates to a drive arrangement for a grinding, lapping or polishing tool body, said drive arrangement comprising a drive rod for the tool body.

Grinding tool bodies or, in short, grinding bodies usually are ceramically-bonded, synthetic resin-bonded, rubber-bonded or sintered abrasive substances, such as aluminum oxide, silicon carbide, boron nitride, diamond, or similar. Lapping bodies serve as lapping means carriers and preferably are made of metals, such as iron, cast iron, brass, copper, tin, lead and the like, or also of mixtures of metal powders of the aforementioned metals and synthetic resin. Lapping means, as a rule, are diamond, boron nitride, silicon carbide, aluminum oxide and the like in aqueous or oily solutions. Polishing bodies, as a rule, consist of soft materials, such as plastics, wood of different degrees of hardness, felts or cloths which take up the polishing means (diamond, boron nitride, SiC, aluminum oxide and the like).

When grinding, lapping or polishing workpieces having arched or grooved surfaces, it has been known to move an corresponding tool body over the surface of the workpiece in a manner that it is articulately coupled with a drive rod which in turn is driven by a drive system comprising a motor. At present, mainly spherical slide rod systems, cf. DE 35 18 631 A or DE 44 11 743 A are generally used, in which the tool body is provided with a spherical bore in which the drive or thrust rod engages with a spherical end. With such a drive arrangement, the tool can follow the workpiece surface in the plane of the drive rod and always rest on it in a flat state, yet it is not possible to direct the tool in circles. It has also been known to articulately connect the drive rod with a tool carrier via a hinge, with the respective lapping, polishing or grinding tool being glued to the lower side of the tool carrier. Consequently, the tool as a whole cannot fall below a certain minimum size, which again will limit the workpieces to be processed as regards the shaping of the workpiece surface which the tool will still be able to treat.

Thus, it is an object of the invention to provide a drive arrangement of the initially defined type with which the guiding movements on all sides can be transmitted to the tool body with the assistance of the drive rod so that any processing desired of the respective workpiece will be possible and by which, moreover, with a view to respectively shaped workpiece surfaces, also tool bodies of minimum size can be used.

SUMMARY

The drive arrangement according to the invention of the initially defined type is characterised in that a substantially cylindrical groove is provided in the tool body for a substantially positive-fit, articulated connection between the tool body and the drive rod, the drive rod engaging in this groove with a rounded, flattened end thereof.

With such a design, the aforementioned object is met in an advantageous manner. The drive rod has a flattened, rounded end so that a flat, disc-shaped coupling piece is formed. The tool body itself and/or a guiding attachment fastened to its upper side, as explained later on in more detail, has a substantially cylindrical, disc-shaped recess in which the disc-shaped end of the drive rod has a positive fit. In this manner, not only reciprocating movements of the tool in the plane of the drive rod can be carried out with the assistance of the drive rod, but also movements transverse thereto, as well as, of course, also combined movements, in particular circulating movements. The tool itself may be pivoted forwards and backwards about the cylindrical axis of the disc-shaped end of the drive rod or its cylindrical groove, respectively, and thus can adapt to the surface of the workpiece during its movements.

On the whole, thus, tools with a rectangular cross-section can be used during grinding, lapping or polishing, where the longitudinal axis of the tools extends in the working direction and can be controlled. The tools may be extremely small, which is particularly important in case of highly arched workpiece surfaces. The use of small tool bodies of rectangular cross-section is also advantageous because such tool bodies are relatively simple and inexpensive to produce, in particular as ceramics bodies or as sintered bodies. Instead of the earlier, rigid articulation systems, also an at least partial movability transversely to the working direction becomes possible, making it possible to control the rotation of the tool about an axis extending perpendicular to the surface of the workpiece.

To control the tool when processing a workpiece, it is advantageous if the axes of the substantially cylindrical groove and of the rounded, flattened end of the drive rod are substantially at right angles to the working direction. Also for the exact guiding and movement transversely to the working direction it is advantageous if the axis of the rounded, flattened end of the drive rod extends in parallel to the working area of the tool body.

To provide for a an easy pivotability of the tool body in a direction transversely to the main working direction relative to the drive rod, so as to enable it to follow a respective workpiece surface profile, it is furthermore suitable if the cylindrical groove has a trapezoidal cross-section, the shorter one of the parallel sides of the trapezium being located at the bottom of the groove. For mounting the end of the drive rod in the groove of the tool body it is also advantageous if a lining is provided in the substantially cylindrical groove of the tool body, which lining preferably is made of metal or plastics, such as, e.g., of brass, aluminum, or a thermoplast or cast resin. In this way, a gentle treatment of the material of the drive rod as well as a long useful life in the region of the articulated "plug" connection drive rod/tool body can be achieved, by simply choosing appropriately matched working materials for lining and drive rod, or its engaging end, respectively. For transverse pivoting movements of the tool body relative to the drive rod, in turn, it is suitable if the cross-section of the lining is substantially trapezoidal.

In case of tool bodies of particular small dimensions, with particularly highly profiled workpiece surfaces, it may be suitable that the substantially cylindrical groove provided for engagement of the drive rod therein is at least partially arranged in a separate guiding or bearing attachment of the tool body so that in the tool body proper only a small depression—if any—need be provided. Accordingly, an advantageous embodiment with the drive arrangement according to the invention is characterized in that the tool body includes an attachment fastened thereto, which attachment preferably is made of metal or plastics, such as brass, aluminum, or a thermoplastic or cast resin, which attachment is provided with a substantially cylindrical groove or with a substantially cylindrical passage groove. In this instance, the attachment may simply be glued to the tool body, welded thereto or soldered therewith.

To avoid wear by direct contact between tool body and drive rod in case of a guiding attachment, it is furthermore also advantageous if the diameter of the substantially cylindrical passage groove of the attachment is smaller than the diameter of the substantially cylindrical groove in the tool body.

To provide for a smooth transition between the attachment and the tool body, it is also advantageous if the substantially cylindrical passage groove in the attachment has substantially the same width as the substantially cylindrical groove in the tool body.

To achieve the desired movability also in transverse direction, so as to ensure pivoting of the tool body relative to the drive rod, in case an attachment is mounted, it is also suitable if the substantially cylindrical passage groove of the attachment has a trapezoidal cross-section, the shorter one of the parallel sides of the trapezium being provided on that side which faces the tool body. In this case it is, moreover, suitable for a smooth transition to the groove in the tool body if the longer one of the parallel sides of the trapezium of the substantially cylindrical groove in the tool body and the shorter one of the parallel sides of the trapezium of the substantially cylindrical passage groove in the attachment substantially have the same lengths.

With a view to a simple installation as well as to a simple production, it is, furthermore, advantageous if the lining is connected with the attachment.

As has already been mentioned, the tool body preferably is a ceramics body or a body of sintered material in a manner known per se. For long periods of operation, the drive rod may be made of metal, yet for obtaining as light-weight an embodiment as possible, in which also an easy production is ensured, it may also be made of plastics, in particular of a fiber-reinforced plastics material.

The rounded, flattened end of the drive rod preferably is integrally formed with the remaining drive rod, yet with a view to a separate production, it may also be glued to the front side of the drive rod body later on, or cast thereto or welded thereto.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

DETAILED DESCRIPTION

Figure 1:
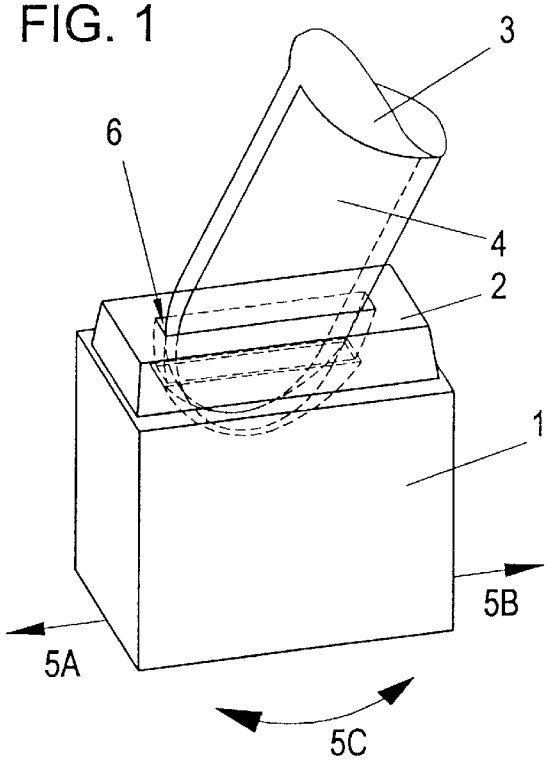
FIG. 1 is a perspective view of a tool body with an end of a drive rod in a broken-off illustration.
Figure 4:
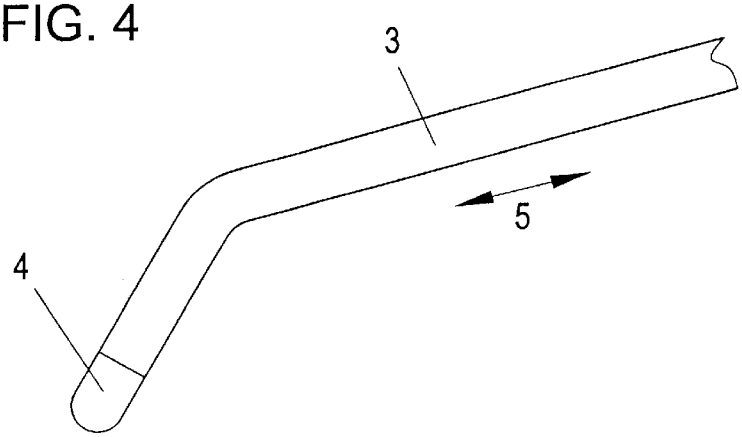
FIG. 4 schematically shows an angular drive rod, yet without illustrating that part which is to be coupled with a drive system including a motor, which part as such is conventional and need not be further explained here.

In FIG. 1, a tool body 1 with an attachment 2 is shown in a perspective view. Tool body 1 has an associated drive rod 3 for driving tool body 1, only the end part of which is illustrated. As is visible, drive rod 3 has flattened sides and a circularly rounded end 4, cf. also FIG. 4 in addition to FIG. 1, and with drive rod or slide rod 3, drive movements primarily in the plane of drive rod 3, cf. double arrow 5 in FIG. 4, are transmitted from a conventional drive system not illustrated in detail to tool body 1, cf. also arrows 5A and 5B in FIG. 1.

With its rounded, flat, disc-shaped end 4, drive rod 3 projects into an at least substantially cylindrical, disc-shaped depression or groove 6 in the tool body 1, or its attachment 2, respectively, the drive rod simply being inserted in this groove 6 with its end 4 and there being held by positive fit. This allows for a pivoting movement between tool body 1 and drive rod 3, or its end 4, respectively, about the cylinder axis 7 of the cylindrical recess 6, transversely to the general working movement 5A, 5B, cf. also FIG. 5 and the double arrow 8 entered therein, about axis 9 of the circular-disc-shaped end 4 of the drive rod 3, this axis 9 coinciding with the groove axis 7 in the exemplary embodiment illustrated.

Figure 2:
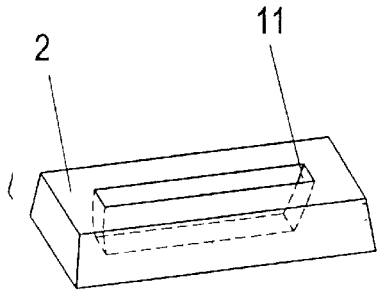
FIG. 2 is a perspective view of an attachment for such a tool body, as it is illustrated in FIG. 1.
Figure 3:
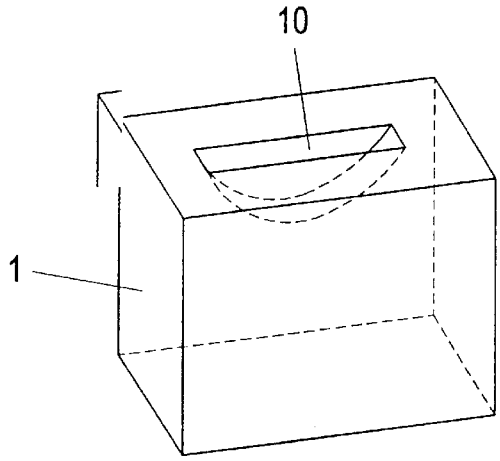
FIG. 3 is a perspective view of the tool body proper.
Figure 5:
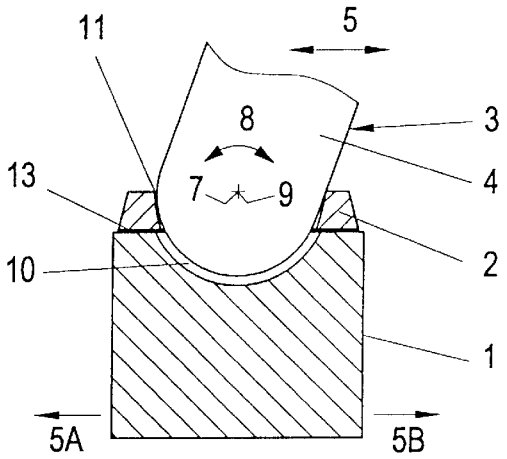
FIG. 5 shows a longitudinal section through a tool body in the embodiment according to FIG. 1, wherein the bearing of the disc-shaped end of the drive rod is visible.

In the exemplary embodiment according to FIGS. 1 to 3 and 5 to 7, the recess 6 each is formed in that, on the one hand, a substantially cylindrical groove 10 is provided in the tool body 1 proper, and that, moreover, a substantially cylindrical groove is provided in the attachment 2, extending through the attachment and termed passage groove 11 in short hereinafter, cf. in particular FIGS. 2, 3 and 5. The passage groove 11 in the attachment 2 may, as is visible from FIG. 5, have a smaller diameter than the groove 10 in the tool body 1 itself so that the bearing forces occurring when work-pieces are processed are accommodated in the region of attachment 2. This will be the case if the processing is carried out in the main working direction 5 by reciprocating the tool body 1 according to arrows 5A, 5B.

Figure 6:
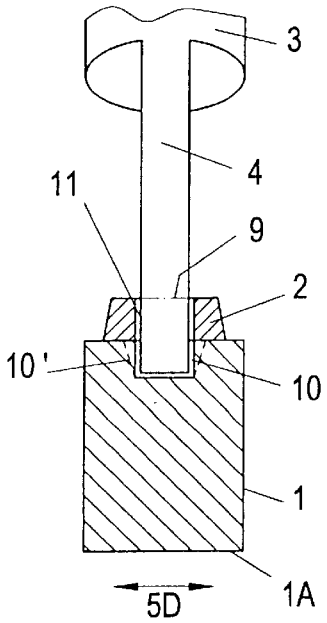
FIG. 6 shows a cross-section through a tool body, illustrating the end of a drive rod coupled therewith.

Moreover, due to the coupling shown between the drive rod end 4 and the tool body 1, also lateral guidance of the tool body 1 is ensured so that lateral and circular working movements are possible, cf. the arched double arrow 5C in FIG. 1, and also the corresponding cross-section according to FIG. 6 from which it follows that transverse movements of the tool body 1 according to double arrow 5D can be transmitted from the drive rod 3 to the tool body 1. This is possible because of the positive fit of the disc-shaped end 4 in the groove recess 6.

Figure 7:
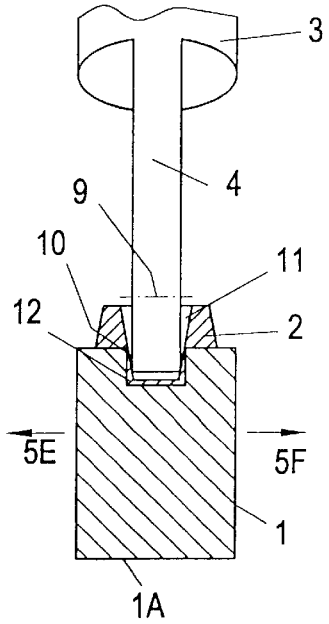
FIG. 7 shows a cross-section through a tool body that is modified as compared to FIG. 6, with an inserted drive rod.

If a pivotability—with a view to the processing of highly profiled workpiece surfaces—is to be additionally achieved for the tool body 1, the cross-section of the grooves 10, 11 may be trapezoidal as shown in FIG. 7, wherein the shorter one of the parallel trapezium sides is located at the lower side each, or at the bottom of the groove, respectively, whereas the longer side of the trapezium is located on top so that the grooves 10, 11 widen in upward direction and thus provide space for the pivoting movement of the disc-shaped end 4 relative to the tool body 1, or its attachment 2, respectively. The pivoting movement of the tool body 1 relative to the end 4 of the drive rod 3 is indicated by arrows 5E, 5F in FIG. 7.

Figure 8:
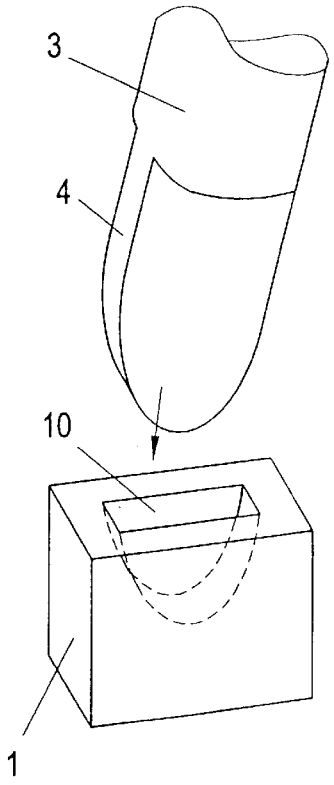
FIG. 8 shows a perspective, exploded illustration of a simple tool body and an associated drive rod end part.

In FIG. 8, a part of the drive rod 3 with its disc-shaped, circularly rounded end 4 is shown above a mere tool body 1 in an exploded illustration, which tool body 1 is sufficiently high so that no attachment, like the attachment 2 according to FIGS. 1 to 7, is provided as a separate guiding and bearing part. The substantially cylindrical groove 10 in the tool body 1 then, of course, will be deeper as compared to groove 10 according to FIGS. 1, 3 or 5, yet (similar to the passage groove 11 in attachment 2) it should correspond to a circular arc of 180° at the most, preferably be somewhat smaller. The circular arc of the rounded end 4 preferably has a somewhat smaller diameter than groove 10.

The tool body 1 consists in a per se conventional manner of ceramics material, sintered material or a comparable material suitable for polishing, lapping or grinding, it being of advantage that, with a view to the controlling possibilities existing here, it may simply be rectangular in its configuration. It is, furthermore, possible to provide the tool body 1 with extremely small dimensions, in the millimeter range, so as to be able to also treat highly profiled workpiece surfaces. The drive rod 3 preferably is made of metal, in particular steel, yet it may also be made of plastics, optionally of a fiber-reinforced plastics material.

In the embodiment according to FIG. 7, the attachment 2 is formed separate from a lining 12 defining the groove 10 in the tool body 1 proper, with both the attachment 2 and the lining 12 possibly being made of a metal or plastics suitable for bearing purposes. It is, however, also possible to produce the attachment 2 and the lining 12 in one piece, as is additionally indicated in FIG. 7 by the hatching oriented in the same direction. This facilitates production as well as mounting. With the lining 12 formed in one piece therewith, attachment 2 may then be seated in a press fit in the groove of the tool body 1. In contrast, the attachment 2 in the embodiment according to FIGS. 1 to 3, 5 and 6 suitably is glued, soldered or welded to the workpiece body 1 proper, as quite schematically illustrated at 13 in FIG. 5. In FIGS. 5, 6 and 7, finally, 1A refers to the working surface of the tool body 1. Furthermore, in FIG. 6 at 10', it is indicated in broken lines that also without a lining 12, a groove of trapezoidal cross-section may be present in tool body 1.

In particular, the attachment 2, or the lining 12, respectively, may be provided in the form of a glued on, pre-shaped metal sheet of brass, aluminum or the like, or in the form of a thermoplastic material shapingly welded on by ultrasonic means, or in the form of a shapingly injection-molded on synthetic resin, or in the form of a glued on injection-molded plastics part.

Accordingly, while at least one embodiment of the present invention has been shown and described, it is to be understood that many changes and modifications may be made thereunto without departing from the spirit and scope of the invention as defined in the appended claims.

What is claimed is:

1. A drive arrangement for a grinding, lapping or polishing tool body comprising:

a drive rod for the tool body, wherein said drive rod has an end with laterally flattened sides and a rounded front end; and a substantially cylindrical groove provided as a bearing surface in the grinding, lapping or polishing tool body wherein said laterally flattened sides and rounded front end of said drive rod engages said substantially cylindrical groove and is pivotally mounted in the grinding, lapping or polishing tool body.

2. A drive arrangement according to claim 1, wherein an axis of said substantially cylindrical groove and an axis of said rounded, flattened end of said drive rod are both oriented at substantially right angles to a working direction.

3. A drive arrangement according to claim 1, wherein said axis of said rounded, flattened end of said drive rod extends parallel to a working surface of the tool body.

4. A drive arrangement according to claim 1, wherein said cylindrical groove has a trapezoidal cross-section, and wherein a shorter parallel side of the trapezium is located at a bottom of said groove.

5. A drive arrangement according to claim 1, further comprising a lining in said substantially cylindrical groove of the tool body, wherein said lining is made of metal or plastic.

6. A drive arrangement according to claim 5, wherein a cross-section of said lining is substantially trapezoidal.

7. A drive arrangement according to claim 1, wherein the tool body comprises an attachment, preferably made of metal or plastic, fastened to the tool body, wherein said attachment has a substantially cylindrical groove or a substantially cylindrical passage groove.

8. A drive arrangement according to claim 7, wherein said attachment is cast on the tool body or glued thereto.

9. A driver arrangement according to claim 7, wherein said attachment is welded to, or soldered with the tool body.

10. A drive arrangement according to claim 7, wherein a diameter of said substantially cylindrical passage groove of said attachment is smaller than a diameter of said substantially cylindrical groove in the tool body.

11. A drive arrangement according to claim 7, wherein said substantially cylindrical passage groove in said attachment has substantially the same width as said substantially cylindrical groove in the tool body.

12. A drive arrangement according to claim 7, wherein said substantially cylindrical passage groove of said attachment has a trapezoidal cross-section, and wherein a shorter parallel side of the trapezium is disposed on a side that faces the tool body.

13. A drive arrangement according to claim 4, wherein a longer parallel side of the trapezium of said substantially cylindrical groove in the tool body and a shorter parallel side of the trapezium of said substantially cylindrical passage groove in said attachment substantially have the same lengths.

14. A drive arrangement according to claim 7, wherein said lining is connected to said attachment.

15. A drive arrangement according to claim 1, wherein the tool body is a ceramic or sintered material body.

16. A drive arrangement according to claim 1, wherein said drive rod is made of metal.

17. A drive arrangement according to claim 1, wherein said drive rod is made of plastic.

18. A drive arrangement according to claim 1, wherein said rounded, flattened end of said drive rod is integrally formed with said drive rod.

19. A drive arrangement according to claim 1, wherein said rounded, flattened end of said drive rod is glued to a drive rod body at a front side thereof, cast thereon or welded thereto.

* * * * *